United States Patent [19]

Mitchell et al.

[11] 4,049,010

[45] Sept. 20, 1977

[54] FINGERNAIL CONDITIONING AND POLISHING METHOD AND APPARATUS

[75] Inventors: Bernard A. Mitchell; Barry E. Shipp, both of Chicago, Ill.

[73] Assignee: Jovan, Inc., Chicago, Ill.

[21] Appl. No.: 665,633

[22] Filed: Mar. 10, 1976

[51] Int. Cl.[2] ..... A45D 40/30

[52] U.S. Cl. ..... 132/88.5

[58] Field of Search ..... 132/73, 73.5, 73.6, 132/88.5; 424/61; 117/64; 106/3

[56] References Cited

U.S. PATENT DOCUMENTS

| | | | |
|---|---|---|---|
| 2,366,260 | 1/1945 | Hickey | 424/61 |
| 3,034,966 | 5/1962 | Williams | 424/61 |
| 3,311,117 | 3/1967 | Thompson | 132/73.6 |
| 3,422,185 | 1/1969 | Kuritzkes | 424/61 |
| 3,483,008 | 12/1969 | Herr | 424/61 |
| 3,725,525 | 4/1973 | Joos | 424/61 |
| 3,917,816 | 11/1975 | Yueh | 424/61 |
| 3,989,817 | 11/1976 | Mayer | 424/61 |

OTHER PUBLICATIONS

Cosmetics Science and Technology —Auther—Edward Sagarin—pp. 709–711 and 400, 1957.

Hackh's—Chemical Dictionary p. 302 1969.

*Primary Examiner*—G.E. McNeill

*Attorney, Agent, or Firm*—Laff, Whitesel & Rockman

[57] ABSTRACT

A simple three-step process conditions and polishes fingernails and toenails. First, the nail is smoothed by a simple and delicate abrasion of the nail surface, to remove all length-wise, surface ridges. Second, a conditioning cream, fortified with protein, is spread over the smooth surface of the nail. The conditioning cream penetrates, protects, and beautifies the nail. Third, the creamed nail is buffed.

14 Claims, 4 Drawing Figures

FINGERNAIL CONDITIONING AND POLISHING METHOD AND APPARATUS

This invention relates to fingernail care, and to the apparatus and methods for accomplishing such care.

There are many reasons why a person is interested in fingernail care. One reason is appearance. Another reason is to protect the nails against damage from both environmental and mechanical abuse. The environmental problems occur when the nails are exposed to too much cold, sun, chlorinated, salty or sudsy water, or dietary deficiencies. Mechanical abuse may occur responsive to almost any cause such as typing, telephone dialing, striking or carelessness. Or, the nail may be damaged if there is a faulty filing, trimming or other manicure care. These and other problems may be overcome or alleviated if the nails are given a natural treatment without too much of the artificial processing steps of the usual manicure, such as filing, scraping, soaking, etc., which has been done heretofore.

There have been methods and procedures for natural nail care. However, they have included very many complicated steps and they have required a very high skill level. Also, the processes used heretofore have employed a number of different products which are inconvenient or bothersome. For example, powders may be spilled, sprinkled, or dusted over people, floors and furniture, and enamel or lacquer may be spilled or broken.

Accordingly, an object of the invention is to provide new and improved apparatus for and methods of nail care. Here an object is to make nails naturally healthier and stonger.

Another object of the invention is to avoid the kind of nail care where problems are merely painted over.

Yet another object is to provide means for and methods of giving mails a healthy appearance or a shine which will last as long as the nail lasts. Here an object is to provide a quick and easy method which does not require any particular training or high skill level. Another object is to enable such nail care without simultaneously causing conditions wherein powders, fluids, chemicals or the like may be dusted, spread, or spilled.

In keeping with this aspect of the invention, these and other objects are accomplished by a simple three-step process wherein the nail is first smoothed by a simple and delicate abrasion of the nail surface to remove all lengthwise surface ridges. The abrasion tool is padded to avoid formation of thick and thin spots on the nail. Then a conditioning cream, fortified with protein, is spread over the smooth surface of the nail and buffed. The conditioning cream penetrates, protects, and beautifies the nail.

The nature of the inventive apparatus and method will become more apparent from a study of the attached drawing wherein.

Figure 1:
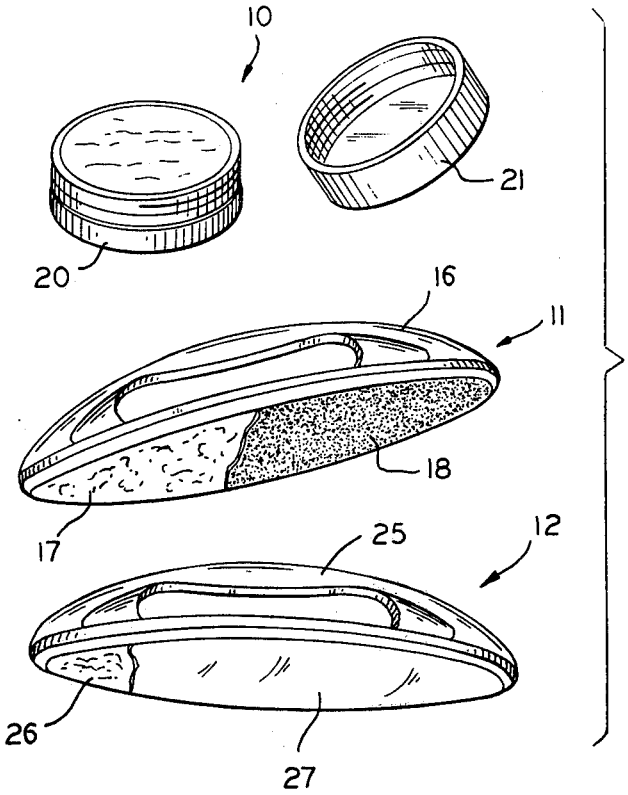
FIG. 1 is a perspective view of a kit used to practice the invention.
Figure 2:
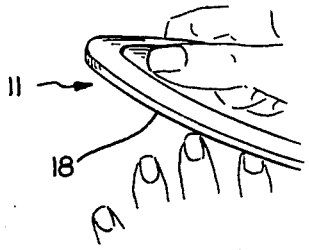
FIG. 2 is a representation of the first or abrasive step in the inventive process wherein the nail is smoothed.
Figure 3:
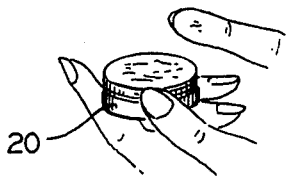
FIG. 3 is a representation of the second or conditioning step in the inventive process wherein the nail is creamed.
Figure 4:
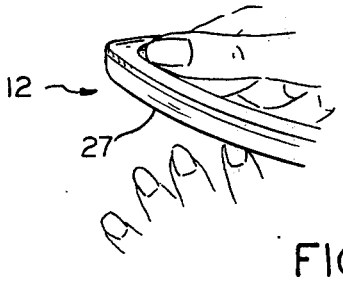
FIG. 4 is a representation of the third or buffing step in the inventive process.

The kit used to practice the invention comprises a nail conditioning cream 10, an abrasive nail smoother 11, and a buff 12. Briefly, the nail is smoothed (FIG. 2) by nail smoother 11; then, the conditioning cream 10 is spread (FIG. 3) on the nail. After the conditioning cream has had a moment to condition the nail, it is buffed (FIG. 4).

In greater detail, the nail smoother preferably comprises a somewhat boat-shaped member having a handle 16, which member is preferably made of a single molded plastic part. A suitable layer of sponge-like padding 17 is formed over the bottom surface of the boat-shaped member. The padding is preferably a layer of dense foam cemented to the bottom of the member. Over the exposed surface of the padding is a paper-like material 18 having an abrasive surface.

The abrasive surface 18 is preferably made of extremely fine particles of limited hardness, which will smooth the surface of the nail without damaging it. This is different from the prior art use of emery boards, which is a relatively coarse abrasive substance that could easily wear away enough of the nail to damage it. According to the invention, a preferred abrasive material is alumina-white (abrasive) and polyethlene. Moreover, the sponge backing 17 enables this sheet of extremely fine abrasive material to conform to the contours of the nail so that the smoothing action occurs uniformly over the entire arcuate cross section of the nail. The sponge material also tends to somewhat accommodate the abrasive surface to the ridges and valleys of the nail so that the abrasion action is more gentle than would otherwise occur.

Next, (FIG. 3) the conditioning cream is spread over the smoothed nail and allowed to stand briefly. The cream is not required to stand for too long a time in order to condition the nails. Therefore, the time required to spread the cream over a number of nails is usually long enough so that the first nail to be creamed may be buffed almost immediately after the last nail has been creamed. The cream is distinctly advantageous, as compared to prior methods which used powder, since there is no dust to clean up, or enamel to spill. Moreover, a powder tends to be forced under the cuticle, whereas the cream is not so forced.

The preferred conditioning cream is a mixture of the following materials:

EXAMPLE 1

| | | |
|---|---|---|
| Glyceryl Monosterate | emulsifier | 3% - 8% |
| Cetyl Alcohol | softener | 1% - 5% |
| Lanolin Anhydrous | softener | 0.1% - 3% |
| Methyl Paraben | preservative | 0.05% - 0.2% |
| Propyl Paraben | preservative | 0.05% - 0.2% |
| Imidazolidinyl Urea | germicide | 0.05% - 0.2% |
| Propylene Glycol | solvent | 30.0% - 60.0% |
| Allantoin | protein | 0.05% - 1.5% |
| Protein | protein | 0.05% - 1.5% |
| Silica | abrasive | 30.0% - 60.0% |
| D & C Red #19 | coloring | sufficient quantity |
| Perfume Oil | perfume | sufficient quantity |

EXAMPLE 2

| | | |
|---|---|---|
| Silica | abrasive | 30.0% - 65.0% |
| Mineral Oil | Mineral Spirits | 30.0% - 60.0% |
| Zinc Stearate | emulsifier | 1.0% - 5.0% |
| Candellila Wax | bodying agent - wax | 1.0% - 3.0% |
| Carnauba Wax | bodying agent - wax | 2.0% - 7.0% |
| Lanolin | emollient | 0.1% - 3.0% |
| Allantoin Proteinate | protein | 0.1% - 3.0% |
| Propylparaben | preservative | 0.05% - 0.5% |
| Perfume | fragrance | quantity sufficient |

-continued

| | | |
|---|---|---|
| D & C Red #19 | coloring | quantity sufficient |

The conditioning cream preferably has a form, texture and consistency somewhat similar to cold cream or shoe polish. Preferably, the cream is supplied in a wide and generally flat container 20, with a screw top 21, so that it is easy to dip the finger tips into it and yet it may be tightly closed.

After the conditioner is applied, the nail is buffed (FIG. 4) with buff 12. This buff comprises a preferably plastic boat-shaped member 25 with an integral handle. Again, the bottom surface of the boat-shaped member is covered by a pad of sponge-like material 26; however, it is preferably firmer than the padding material 17 used on the nail smoother. This sponge pad is firmly wrapped with a chamois skin, or the equivalent.

The advantages of the invention should now be apparent. The alternate longitudinal ridges and valleys on the nails form discontinuities of different mechanical strength, which lead to cracks, nicks or outright breakage of the nails. Removal of these discontinuities make the nails stronger since there is no localized weakage which creates a preferred point of breakage. The conditioners in the cream remove dryness and brittleness and make the nails more supple and, therefore, less likely to break under mechanical strain. In addition, the waxes shine and the protein strenghtens the nails.

Those who are skilled in the art will readily perceive how modifications may be made in the invention. Therefore, the appended claims are to be construed to cover all equivalent structures.

I claim:

1. A method of conditioning and polishing fingernails or toenails comprising the steps of:

a. smoothing the surface of the nail by a delicate abrasion to remove substantially all longitudinal ridges without locally wearing away part of the nail;

b. applying a conditioning cream over the smoothed surface of said nail, said conditioning cream comprising at least softeners, preservatives, and protein; and c. buffing said cream and said nail.

2. The method of claim 1 wherein said cream includes at least:

two softeners
two preservatives
a solvent, and
two proteins.

3. The method of claim 2 wherein said cream further includes:

a germicide
an emulsifier, and
an abrasive.

4. The method of claim 3 where said cream further includes:

coloring and
perfume.

5. The method of claim 1 wherein said cream includes at least:

two softeners forming 1% to 8% of said cream,
two preservatives forming 0.1% to 0.4% of said cream,
a solvent forming 30% to 60% of said cream and
two proteins forming 0.1% to 3% of said cream.

6. The method of claim 5 wherein said cream further includes:

a germicide forming 0.05% to 0.2% of said cream,
an emulsifier forming 3% to 8% of said cream, and
an abrasive forming 30% to 60% of said cream.

7. The method of claim 6 wherein said cream further includes:

coloring and
perfume.

8. The method of claim 1 wherein said cream comprises:

Cetyl Alcohol forming 1% to 5% of said cream,
Lanolin Anhydrous forming 0.1% to 3% of said cream,
Methyl Paraben forming 0.05% to 0.2% of said cream,
Propyl Paraben forming 0.05% to 0.2% of said cream,
Imidazolidinyl Urea forming 0.05% to 0.2% of said cream,
Propylene Clycol forming 30% to 60% of said cream,
Allantoin forming 0.05% to 1.5% of said cream, and
Protein forming 0.05% to 1.5% of said cream.

9. The method of claim 8 wherein said cream further comprises:

Clyceryl Monosterate forming 3% to 8% of said cream and
Silica forming 30% to 60% of said cream.

10. The method of claim 9 wherein said cream further comprises:

D & C Red 19 and
Perfume Oil.

11. A method of conditioning and polishing fingernails or toenails comprising the steps of;

a. smoothing the surface of the nail by a delicate abrasion to remove substantially all longitudinal ridges without locally wearing away part of the nail;

b. applying a conditioning cream over the smoothed surface of said nail, said conditioning cream comprising at least softeners, preservatives, and protein; wherein said cream comprises:

Zinc Stearate forming 1% to 5% of said cream,
Candellila Wax forming 1% to 3% of said cream,
Carnauba Wax forming 2% to 7% of said cream,
Lanoling forming 1% to 3% of said cream,
Allantoin Proteinate forming 1% to 3% of said cream, and Propylparaben forming 1% to 3% of said cream; and c. buffing said cream and said nail.

12. The method of claim 11 wherein said cream further comprises:

Silica forming 30% to 65% of said cream, and
Mineral Oil forming 30% to 60% of said cream.

13. The method of claim 12 wherein said cream further comprises:

Perfume and
D & C Red No. 19.

14. A method of conditioning and polishing fingernails or toenails comprising the steps of:

a. smoothing the surface of the nail by a delicate abrasion to remove substantially all longitudinal ridges without locally wearing away part of the nail;

b. applying a conditioning cream over the smoothed surface of said nail, said conditioning cream comprising at least softeners and preservatives; and c. buffing said cream and said nail.

* * * * *

UNITED STATES PATENT AND TRADEMARK OFFICE

CERTIFICATE OF CORRECTION

PATENT NO. : 4,049,010

DATED : September 20, 1977

INVENTOR(S) : Bernard A. Mitchell et al.

It is certified that error appears in the above-identified patent and that said Letters Patent are hereby corrected as shown below:

Col. 1, line 38, change "mails" to --nails--; col. 4, line 44, change "lanoling" to --lanolin--.

Signed and Sealed this

Second Day of May 1978

[SEAL]

Attest:

RUTH C. MASON
Attesting Officer

LUTRELLE F. PARKER
Acting Commissioner of Patents and Trademarks